US010961069B2

(12) United States Patent
Hiro

(10) Patent No.: US 10,961,069 B2
(45) Date of Patent: Mar. 30, 2021

(54) SHEET CONVEYANCE APPARATUS

(71) Applicant: SHARP KABUSHIKI KAISHA, Sakai (JP)

(72) Inventor: Hideyuki Hiro, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/911,283

(22) Filed: Jun. 24, 2020

(65) Prior Publication Data

US 2020/0407184 A1 Dec. 31, 2020

(30) Foreign Application Priority Data

Jun. 26, 2019 (JP) ..... JP2019-118205

(51) Int. Cl.
*B65H 9/14* (2006.01)
*B65H 9/00* (2006.01)
*B65H 7/20* (2006.01)

(52) U.S. Cl.
CPC ..... *B65H 9/006* (2013.01); *B65H 7/20* (2013.01)

(58) Field of Classification Search
CPC ..... B65H 9/00; B65H 9/002; B65H 9/006; B65H 7/20
See application file for complete search history.

(56) References Cited

U.S. PATENT DOCUMENTS 5,690,329 A * 11/1997 Van Peteghem ..... B41J 11/58 206/215
5,831,741 A * 11/1998 Milillo ..... B65H 9/20 356/429
2014/0140744 A1* 5/2014 Akai ..... G03G 15/607 399/371
2019/0161298 A1* 5/2019 Arai ..... B65H 5/062

FOREIGN PATENT DOCUMENTS

JP 2003-005582 A 1/2003

* cited by examiner

*Primary Examiner* — Thomas A Morrison
(74) *Attorney, Agent, or Firm* — ScienBiziP, P.C.

(57) ABSTRACT

When an open hole is detected at the front end of a sheet at a conveyance start position, a registration operation to correct a tilt posture of the sheet is avoided, and the present velocity is retrained to convey the sheet without temporarily stopping the sheet having the tilt posture.

2 Claims, 11 Drawing Sheets

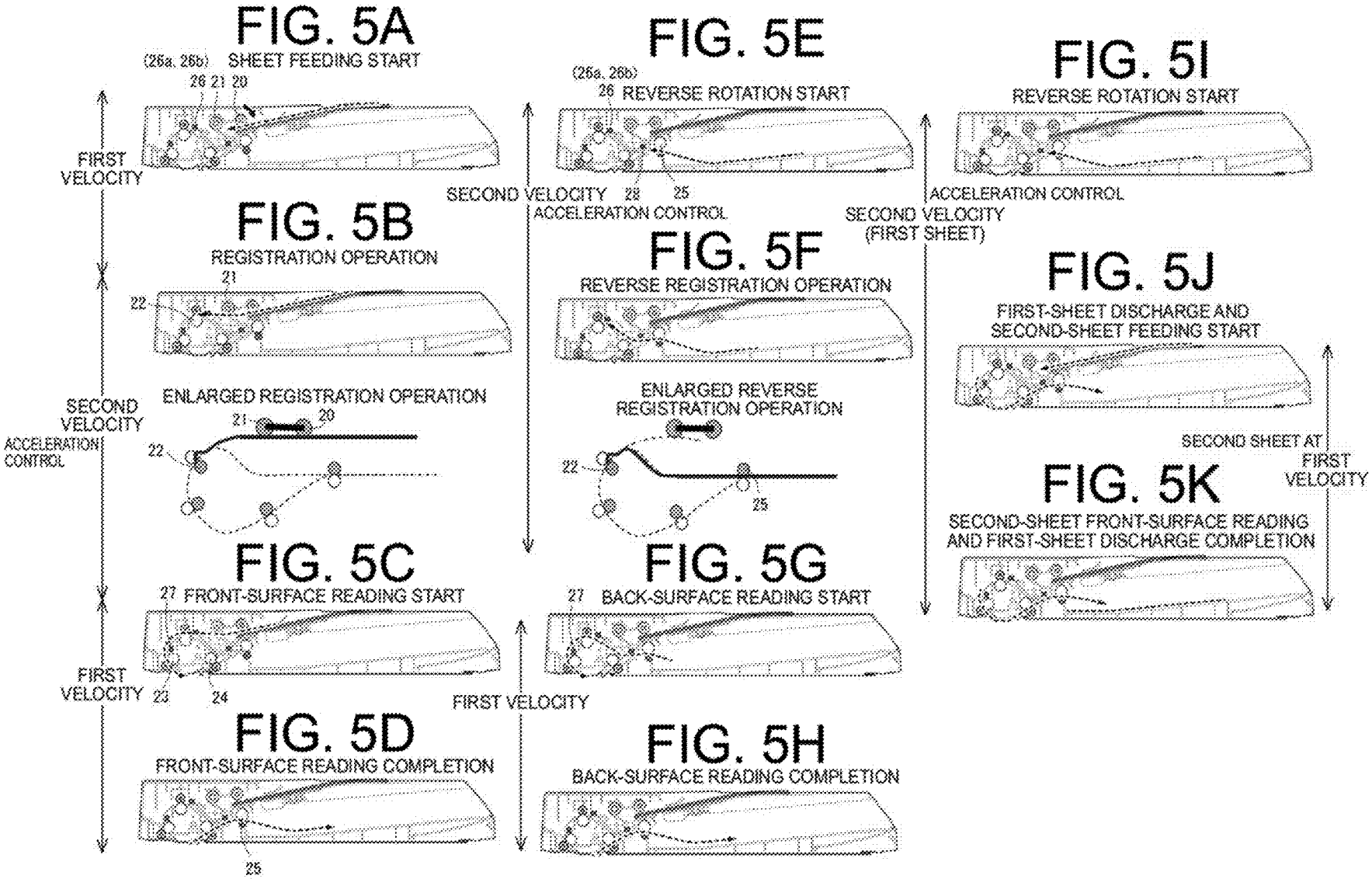
FIG. 5A
SHEET FEEDING START
(26a, 26b)
26
21
20
FIRST VELOCITY
FIG. 5B
REGISTRATION OPERATION
21
22
ENLARGED REGISTRATION OPERATION
20
21
22
SECOND VELOCITY
ACCELERATION CONTROL
FIG. 5C
FRONT-SURFACE READING START
27
24
23
FIRST VELOCITY
FIG. 5D
FRONT-SURFACE READING COMPLETION
25
FIG. 5E
REVERSE ROTATION START
(26a, 26b)
26
28
25
SECOND VELOCITY
ACCELERATION CONTROL
FIG. 5F
REVERSE REGISTRATION OPERATION
ENLARGED REVERSE REGISTRATION OPERATION
22
25
FIG. 5G
BACK-SURFACE READING START
27
FIRST VELOCITY
FIG. 5H
BACK-SURFACE READING COMPLETION
FIG. 5I
REVERSE ROTATION START
ACCELERATION CONTROL
SECOND VELOCITY (FIRST SHEET)
FIG. 5J
FIRST-SHEET DISCHARGE AND SECOND-SHEET FEEDING START
SECOND SHEET AT FIRST VELOCITY
FIG. 5K
SECOND-SHEET FRONT-SURFACE READING AND FIRST-SHEET DISCHARGE COMPLETION

FIG. 6A

CONVEY TO FIRST CONVEYANCE SENSOR AT REGULAR VELOCITY (E.G., READING VELOCITY).

DISABLE REGISTRATION AND ACCELERATION CONTROL WHEN FIRST CONVEYANCE SENSOR DETECTS HOLE AND PROCEED TO (b).

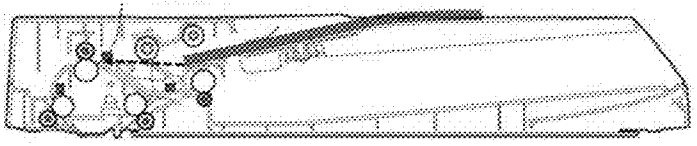

FIG. 6B

REGULAR VELOCITY UNTIL FRONT-SURFACE READING IS COMPLETED.

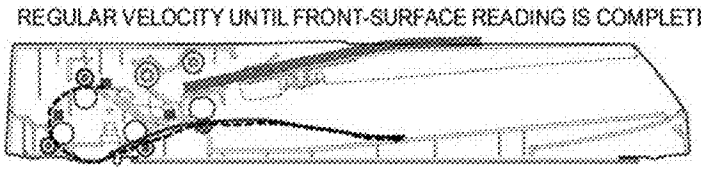

FIG. 6C

ENABLE ACCELERATION CONTROL UNTIL DOCUMENT REAR END REACHES REVERSE-ROTATION STOP POSITION AFTER FRONT-SURFACE READING IS COMPLETED, AS DOCUMENT FRONT END HAS ALREADY PASSED THROUGH ROLLER.

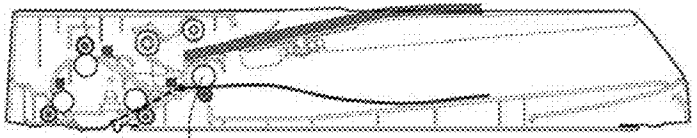

FIG. 6D

ENABLE ACCELERATION CONTROL BEFORE BACK-SURFACE READING POSITION AND ALSO ENABLE REGISTRATION CONTROL, AS PUNCH HOLE IS LOCATED AT DOCUMENT REAR END DUE TO REVERSE ROTATION.

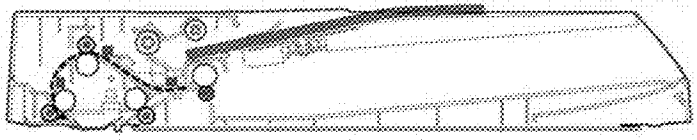

FIG. 6E

ENABLE ACCELERATION CONTROL UNTIL DOCUMENT REAR END REACHES REVERSE-ROTATION STOP POSITION AFTER BACK-SURFACE READING IS COMPLETED, AS DOCUMENT FRONT END HAS ALREADY PASSED THROUGH ROLLER.

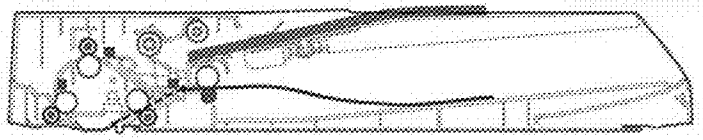

FIG. 6F

DISABLE ACCELERATION DURING THIRD PASS UNTIL DOCUMENT FRONT END HAS PASSED THROUGH SHEET DISCHARGE ROLLER.

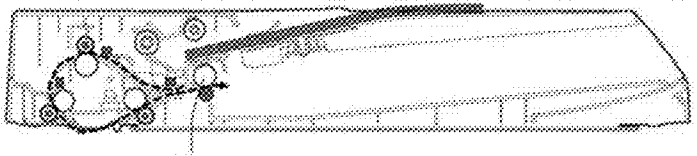

FIG. 6G

ENABLE ACCELERATION CONTROL DURING THIRD PASS AFTER DOCUMENT FRONT END HAS PASSED THROUGH SHEET DISCHARGE ROLLER.

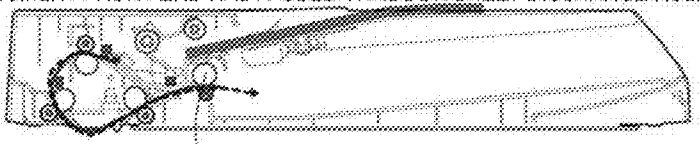

FIG. 7A

DETERMINE REAR END HOLE DURING DOCUMENT FRONT-SURFACE CONVEYANCE/READING.

DISABLE REGISTRATION AND ACCELERATION CONTROL ON DOCUMENT FRONT END AFTER REVERSE ROTATION CONTROL WHEN HOLE IS DETECTED AT REAR END AND PROCEED TO (b).

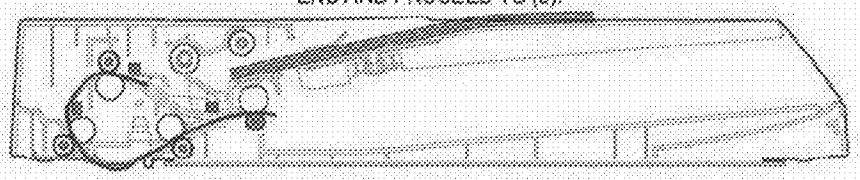

FIG. 7B

DISABLE ACCELERATION CONTROL DURING BACK-SURFACE CONVEYANCE AND ALSO DISABLE REGISTRATION CONTROL, AS HOLE IS LOCATED AT DOCUMENT FRONT END DUE TO REVERSE ROTATION.

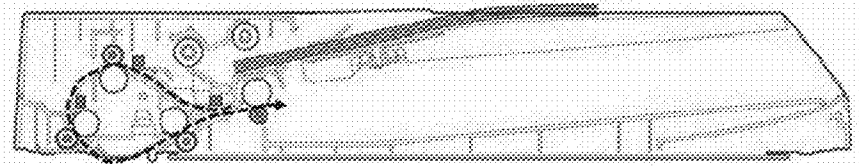

FIG. 7C

ENABLE ACCELERATION CONTROL UNTIL DOCUMENT REAR END REACHES REVERSE-ROTATION STOP POSITION AFTER BACK-SURFACE READING IS COMPLETED, AS DOCUMENT FRONT END HAS ALREADY PASSED THROUGH ROLLER.

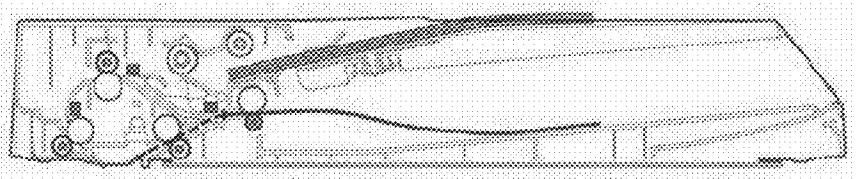

FIG. 7D

ENABLE ACCELERATION CONTROL UNTIL SHEET DISCHARGE IS COMPLETED.

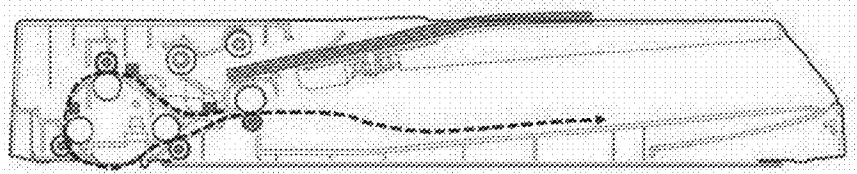

FIG. 8A
CONVEY TO FIRST CONVEYANCE SENSOR AT REGULAR VELOCITY (E.G., READING VELOCITY)
PROCEED TO (b) WHEN FIRST CONVEYANCE SENSOR DETECTS HOLE.
ENABLE REGISTRATION AND ACCELERATION CONTROL WHEN FIRST CONVEYANCE SENSOR DETECTS NO HOLE.
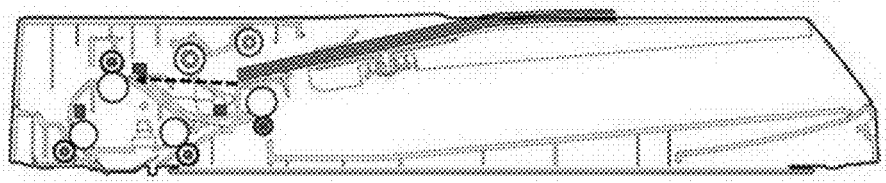
FIG. 8B
ENABLE REGISTRATION CONTROL AT REGULAR VELOCITY.
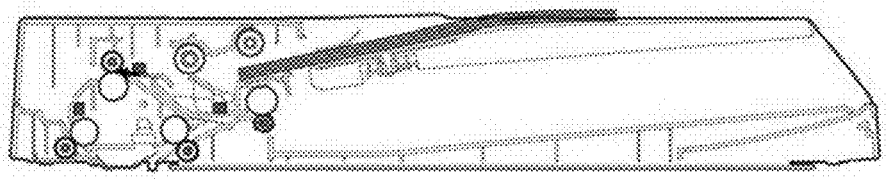
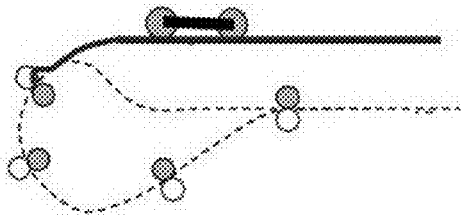

FIG. 9A
DETERMINE REAR END HOLE DURING DOCUMENT FRONT-SURFACE CONVEYANCE/READING.
PROCEED TO (b) AFTER RESERVE ROTATION CONTROL WHEN REAR END HOLE IS DETECTED.
ENABLE REGISTRATION AND ACCELERATION CONTROL WHEN NO REAR END HOLE IS DETECTED.
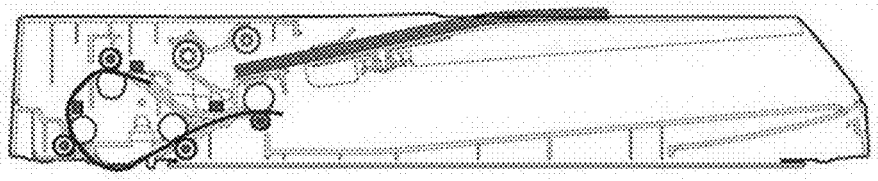
FIG. 9B
ENABLE REGISTRATION CONTROL AT REGULAR VELOCITY.
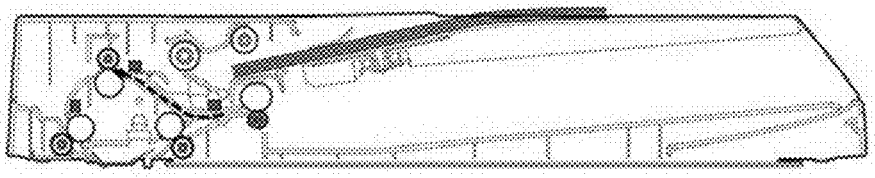
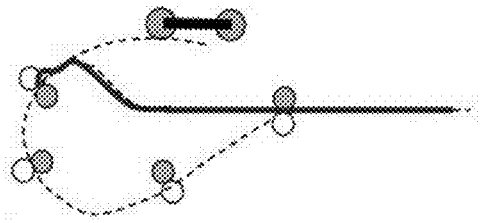

FIG. 10A

CONVEY TO FIRST CONVEYANCE SENSOR AT REGULAR VELOCITY (E.G., READING VELOCITY)

PROCEED TO (b) WHEN NO FRONT END HOLE IS DETECTED.

ENABLE REGISTRATION AND ACCELERATION CONTROL WHEN NO FRONT END HOLE IS DETECTED.

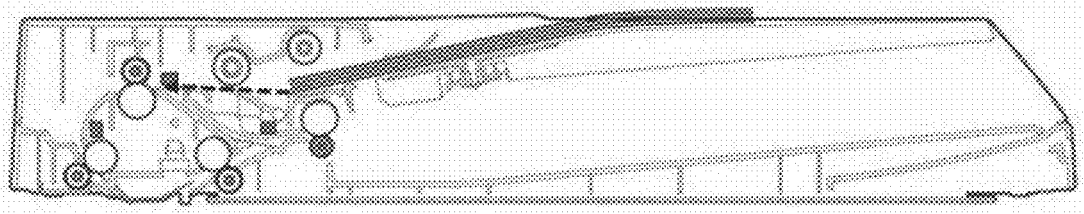

FIG. 10B

REDUCE VELOCITY TO LOWER THAN REGULAR VELOCITY (E.G., READING VELOCITY) AND ENABLE REGISTRATION OPERATION AND CONVEYANCE CONTROL.

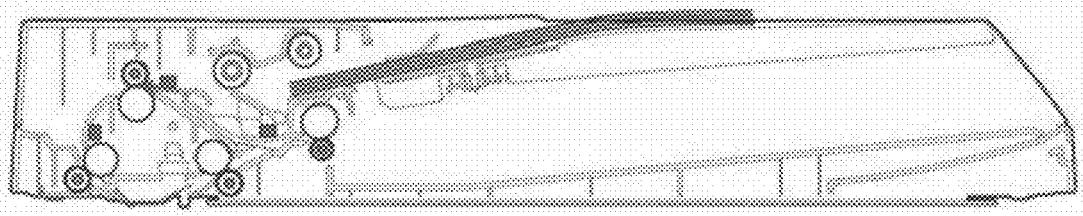

FIG. 10C

INCREASE VELOCITY TO REGULAR VELOCITY (E.G., READING VELOCITY) AFTER REGISTRATION OPERATION AND BEFORE FRONT-SURFACE READING.

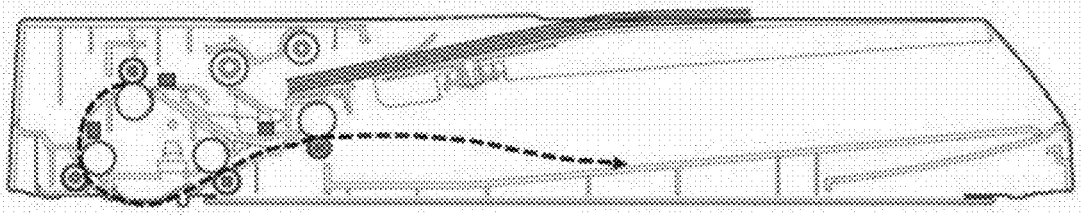

FIG. 11A

PROCEED TO (b) AFTER REVERSE ROTATION CONTROL WHEN REAR END HOLE IS DETECTED.

ENABLE REGISTRATION AND ACCELERATION CONTROL WHEN NO REAR END HOLE IS DETECTED.

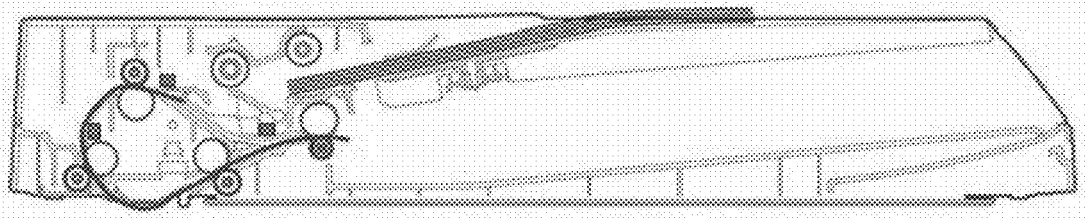

FIG. 11B

REDUCE VELOCITY TO LOWER THAN REGULAR VELOCITY (E.G., READING VELOCITY) AND ENABLE REGISTRATION OPERATION AND CONVEYANCE CONTROL.

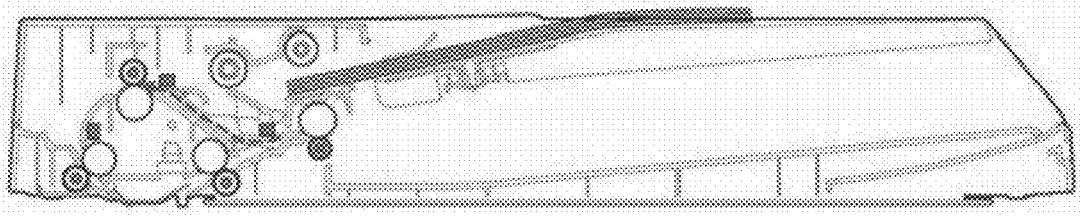

FIG. 11C

INCREASE VELOCITY TO REGULAR VELOCITY (E.G., READING VELOCITY) AFTER REGISTRATION OPERATION AND BEFORE FRONT-SURFACE READING.

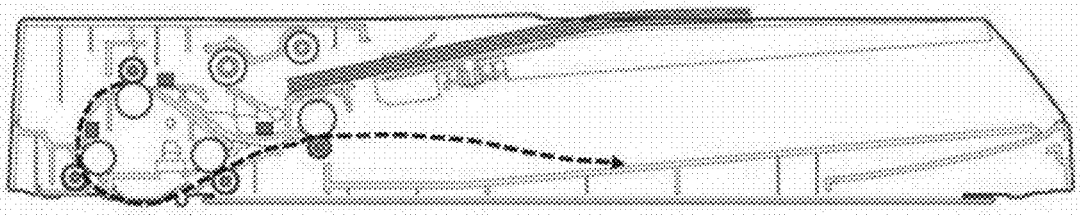

SHEET CONVEYANCE APPARATUS

BACKGROUND OF THE INVENTION

Field of the Invention

The present invention relates to a sheet conveyance apparatus that may convey a sheet without causing any damages to the sheet and that is typically implemented as an image reading apparatus or an image forming apparatus.

Description of the Background Art

In image reading apparatuses such as copiers or fax machines, the registration control is typically adopted to eliminate the skew of the conveyed sheet so as to correctly acquire the image information from the sheet. For the registration control, the sheet is temporarily pressed against the stopped registration roller so that the tilt posture of the sheet is corrected.

As a sheet having a punch hole, or the like, is weak particularly at the front end thereof, the sheet may get damaged, e.g., the front end of the sheet may be bent, during the registration control. This disadvantage may occur in an image forming apparatus as well as an image reading apparatus, for example, in the process of conveying a loose leaf.

In consideration of the above-described disadvantage, Japanese Unexamined Patent Application Publication No. 2003-005582 discloses the invention to avoid the registration control for a sheet having a punch hole. However, with the simple avoidance control disclosed in Japanese Unexamined Patent Application Publication No. 2003-005582, it is difficult to respond to the demand for high-velocity operation of image reading apparatuses.

Specifically, in an image reading apparatus, there is a need to convey a sheet during the time of image reading at a predetermined velocity based on, for example, the reading capability of the apparatus or the reading resolution designated by the user, while there is a demand for a fast conveyance of a sheet and an increase in the processing speed at times other than the time of image reading. The same holds for image forming apparatuses, and there is a demand for a high-velocity conveyance of a sheet at times other than the time of image forming.

The present invention has been made in consideration of the above-described disadvantage and has an object to provide a sheet conveyance apparatus that may convey a sheet at a high velocity while preventing damages such as bending to a sheet.

SUMMARY OF THE INVENTION

In order to solve the above-described disadvantage, an invention according to claim 1, i.e., a sheet conveyance apparatus, includes a sheet conveyer is capable of conveying a sheet at a given velocity from a start position to an end position, an opening detector that is capable of detecting an open hole of a sheet being conveyed, a registration device that temporarily stops a sheet being conveyed as needed and is capable of correcting a tilt posture of the sheet, an image processor that acquires image information from a sheet being conveyed or forms an image on the sheet being conveyed, in which the sheet conveyance apparatus further includes a first device that conveys a sheet at a predetermined regular velocity at a timing when the image processor is enabled, and a second device that is enabled to avoid an operation of the registration device and keep a present velocity a to convey the sheet without temporarily stopping the sheet having a tilt posture when the opening detector detects the open hole at a front end of the sheet at the start position.

The present invention is typically implemented as, for example, an image reading apparatus such as a scanner apparatus, a copier, or a fax machine, or an image forming apparatus such as a printer. According to the present invention, the end position includes the stop position (see FIG. 5K) after sheet discharge and also the temporary stop position (the reverse-rotation stop position according to an embodiment) for double-sided documents. The start position corresponds to a document placement table 50 according to an embodiment. These points are also applied to the invention described below.

The invention according to claim 1 corresponds to, for example, a first characteristic configuration according to an embodiment. Furthermore, the invention according to claim 2 corresponds to a second characteristic configuration according to an embodiment and, when the opening detector detects the open hole at a rear end of the sheet at the start position, is enabled to avoid an operation of the registration device and keep a present velocity to convey the sheet without temporarily stopping the sheet having a tilt posture.

The invention according to claim 3 corresponds to a third characteristic configuration according to an embodiment and, when the open hole is not present at the front end of the sheet temporarily stopped by the registration device even though the opening detector detects the open hole, enables the registration device and conveys the temporarily stopped sheet at a velocity higher than the regular velocity.

According to the present invention described above, it is possible to provide a sheet conveyance apparatus that may convey a sheet at a high velocity while preventing damages such as bending of a sheet.

BRIEF DESCRIPTION OF THE DRAWINGS

FIGS. 5A to 5K is a diagram illustrating a conveyance path for a regular document having no punch hole;

FIGS. 6A to 6G are diagrams illustrating a first conveyance control method 1 when a punch hole is present only at the front end of a document;

FIGS. 7A to 7D are diagrams illustrating the first conveyance control method 1 when a punch hole is present at the rear end of the document;

FIGS. 8A and 8B are diagrams illustrating a second conveyance control method 2 when a punch hole is present at the front end of the document;

FIGS. 9A and 9B are diagrams illustrating the second conveyance control method 2 when a punch hole is present at the rear end of the document;

FIGS. 10A to 10C are diagrams illustrating a third conveyance control method 3 when a punch hole is present at the front end of the document;

FIGS. 11A to 11C are diagrams illustrating the third conveyance control method 3 when a punch hole is present at the rear end of the document.

DESCRIPTION OF THE PREFERRED EMBODIMENTS

Figure 1:
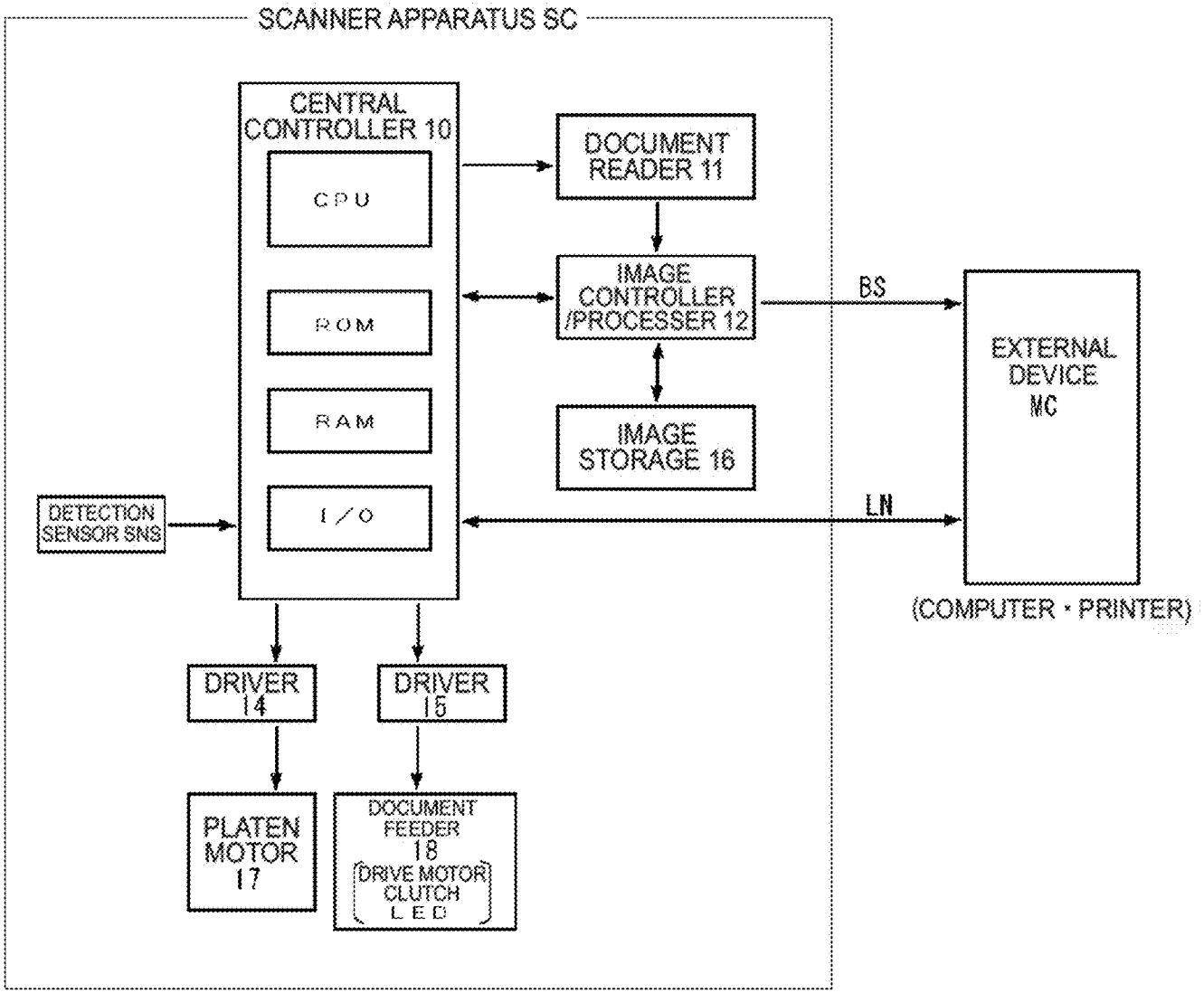
FIG. 1 is a block diagram illustrating the overall configuration of a scanner apparatus according to an embodiment.
Figure 2:
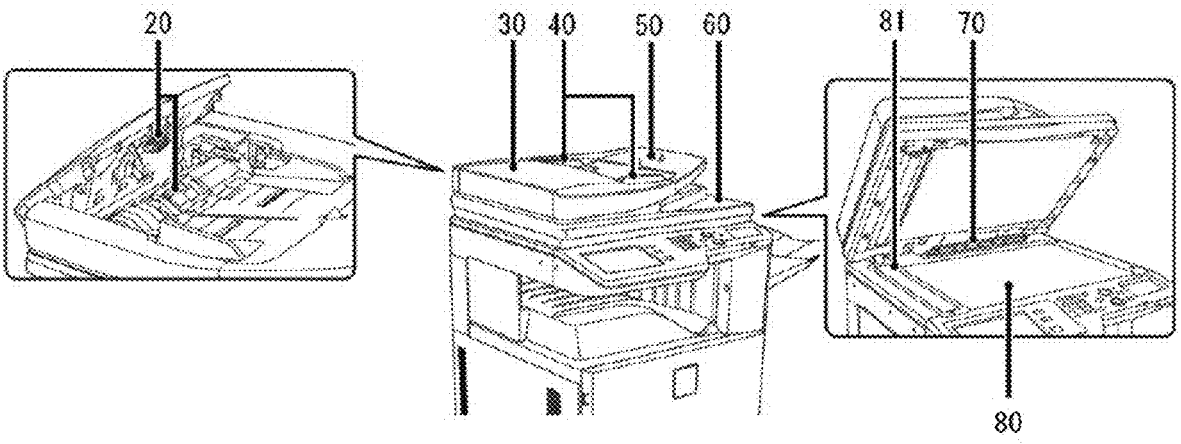
FIG. 2 is a diagram illustrating a relevant part of the scanner apparatus.
Figure 3:
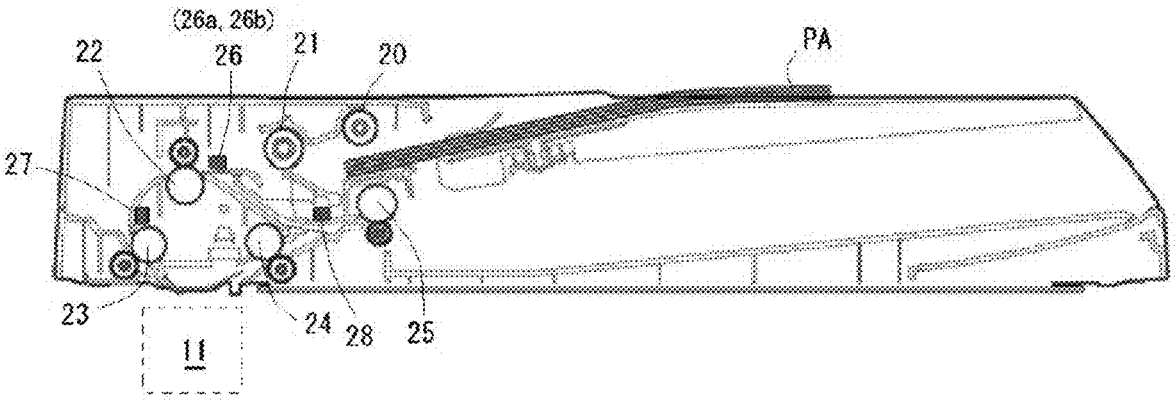
FIG. 3 is a schematic cross-sectional view illustrating a document feeding mechanism.

A sheet conveyance apparatus according to an embodiment is described below. In the following description, a scanner apparatus SC is regarded as an example of the sheet conveyance apparatus. FIG. 1 is a block diagram illustrating the overall configuration of the scanner apparatus SC according to an embodiment. FIGS. 2 and 3 are diagrams illustrating relevant parts of the scanner apparatus SC.

The scanner apparatus SC illustrated in FIG. 1 is coupled to an external device MC, such as a computer or a printer, while in use, and a central controller 10 including a central processing unit (CPU), a read-only memory (ROM), a random-access memory (RAM), an input/output (I/O) port, etc. controls the overall scanner operation. The central controller 10 is coupled to the external device MC, such as a computer, via a communication line LN so as to execute a control operation in response to an instruction received from the external device MC.

The central controller 10 is coupled to a document reader 11 that reads an image printed on a sheet (hereinafter referred to as a document), an image controller/processor 12 that acquires image information from the document reader 11 and executes decoding processing, etc., a plurality of detection sensors SNS that may detect the conveyance position or a punch hole of a document, and a plurality of drivers 14 and 15 that output motor drive data or light-emitting diode (LED) drive data received from the central controller 10.

The document reader 11 includes an image sensor such as a charge coupled device (CCD) or a contact image sensor (CIS), an optical mechanism that generates an image formed on the image sensor, and an analog front end (AFE) unit that converts analog image data into digital image data. A part of the optical mechanism is configured to be capable of moving and sweeping along a document under a transparent placement table 80.

The image controller/processor 12 includes, for example, a digital signal processor (DSP) or a dedicated CPU to perform image processing on a raw image received from the AFE unit and convert the image as appropriate. The image storage 16 stores the image data having undergone image processing. The image controller/processor 12 is configured to be capable of transmitting image data to the external device MC via an image data bus BS.

The detection sensor SNS includes a first conveyance sensor 26, a second conveyance sensor 27, and a third conveyance sensor 28 illustrated in FIG. 3. Each of the first conveyance sensor 26, the second conveyance sensor 27, and the third conveyance sensor 28 includes, for example, one or more pairs of optical sensors in which a light emitting element and a light receiving element are opposed to each other.

When the driver 14 receives motor drive data from the central controller 10, the driver 14 outputs the motor drive data to a platen motor 17 to move the optical mechanism of the document reader 11. The drivers 15 are configured to feed necessary drive data to a document feeder 18. The document feeder 18 includes a plurality of conveyance motors that conveys a document, a clutch that temporarily stops a predetermined conveyance motor to perform a registration operation, and various types of LEDs.

Each of the conveyance motors receives motor drive data from the central controller 10 via the corresponding driver 15. A sheet feed roller 20, a separation roller 21, a registration roller 22, a pre-reading roller 23, a post-reading roller 24, and a sheet-discharge reverse rotation roller 25, illustrated in FIG. 3, are driven to rotate at the required timing. The input document is delivered from the separation roller 21 to the registration roller 22, from the registration roller 22 to the pre-reading roller 23, from the pre-reading roller 23 to the post-reading roller 24, and then from the post-reading roller 24 to the sheet-discharge reverse rotation roller 25 so that the operation to read the image on the front surface of the document is completed.

The conveyance motor according to the embodiment is configured by using, but is not limited thereto, a stepping motor and is configured to rotate at an appropriate conveying velocity as the central controller 10 changes the update cycle of the motor drive data. According to the embodiment, the conveying velocity is switched between a first velocity for the image data reading and a second velocity for the acceleration control under the control of the central controller 10. The first velocity is lower than the second velocity. Depending on the reading resolution, etc., the first velocity is, for example, but is not limited thereto, 300 mm/s, and the second velocity is, for example, but is not limited thereto, 360 mm/s.

FIG. 2 illustrates a relevant part of the document feeder 18 in the scanner apparatus SC according to the embodiment. FIG. 2 illustrates the sheet feed roller 20, a sheet feeder cover 30, a document guide 40, the document placement table 50, a document output device 60, a size detection plate 70, and the transparent placement table 80. As the transparent placement table 80 includes a transparent glass plate, the document reader 11, and the like, are visible from a left end 81 of the transparent placement table 80.

The sheet feed roller 20 is configured to intermittently start rotating and receive a document placed on the document placement table 50. The separation roller 21 (see FIG. 3) is located downstream of the sheet feed roller 20 so that, even when multiple documents are received, only one document is selected.

The sheet feeder cover 30 is configured to open as needed in the case of a sheet jam or during the cleaning of the sheet feed roller 20. The document guide 40 is configured to enable the manual setting of the guide width so as to match with the document size. The scanner apparatus SC is configured to be capable of reading double-sided documents that have printing on both sides thereof. In the case of reading a one-sided document, the document needs to be placed such that the reading surface faces upward.

The size detection plate 70 functions to detect the size of a document placed on the transparent placement table 80. The document reader 11 and the platen motor 17 are provided under the left end 81 of the transparent placement table 80.

FIG. 3 illustrates the positional relationship among a plurality of stacked documents PA, the first conveyance sensor 26, the second conveyance sensor 27, and the third conveyance sensor 28 provided on the document conveyance path, and the sheet feed roller 20, the separation roller 21, the registration roller 22, the pre-reading roller 23, the post-reading roller 24, and the sheet-discharge reverse rotation roller 25 that convey a document at the appropriate velocity and at the appropriate timing. The first conveyance sensor 26 includes, but are not limited thereto, a skew sensor **26*a* that is capable of detecting the right and left positions of the front end of a document; and a punch hole sensor 26*b*** that is capable of detecting a punch hole at the front end area or the rear end area of a document.

The skew sensor 26*a* includes, for example, optical sensors that are provided at the right and left positions of a document perpendicular to a document traveling direction. When it is determined that the document is delivered at a tilt based on the output of the skew sensor 26*a*, a registration control operation, i.e., pressing the document against the stopped registration roller 22, is performed in principle.

The punch hole sensor 26*b* includes, for example, one or more pairs of optical sensors (a light emitting element and a light receiving element) provided in the direction perpendicular to the document traveling direction. To accurately detect a punch hole, it is preferable to use a CCD image sensor, or the like, to read the document image or to arrange a large number of light emitting elements and light receiving elements in rows.

Figure 4:
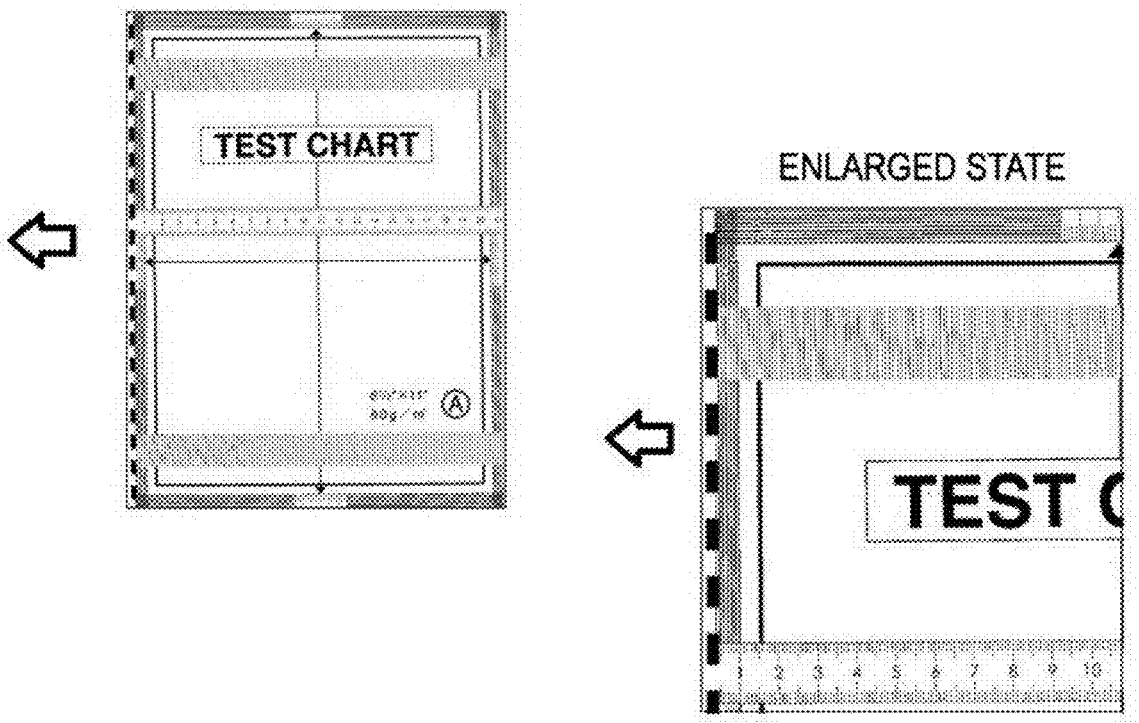
FIG. 4 is a diagram illustrating a document having an open hole.

When a sheet has no more than two or three punch holes, the strength of the sheet is almost the same as that of a regular sheet; therefore, the present embodiment does not assume such a case. That is, the present embodiment primarily assumes a case where a large number of punch holes are formed in a direction perpendicular to the document traveling direction indicated by arrows in FIG. 4.

It is considered that, to detect a punch hole, there are typical determination methods, i.e., a determination method (1) that is to determine a punch hole at the front end side and the rear end side based on an output of the punch hole sensor 26*b* during the first passage (first pass) of a document; and a determination method (2) that is to determine only a punch hole at the front end side during the first passage (first pass) of a document and determine a punch hole at the rear end side in accordance with the subsequent reading operation by the document reader 11. In the case of a double-sided document, there may be a determination method (3) that is to determine a punch hole at the rear end side based on an output from the punch hole sensor 26*b* during the second passage (second pass) of a document.

Conveyance Control on Document Having No Punch Hole

Based on the above description, the conveyance operation for a regular document having no punch hole is described with reference to FIGS. 5A to 5K. For convenience, a double-sided document is described here.

After a document is placed on the document placement table (start position) 50 and a start switch is operated, the sheet feed roller 20 starts to rotate while the document is pressed (see FIG. 5A). Accordingly, the document passes through the separation roller 21 and reaches the position of the first conveyance sensor 26. The right and left positions of the front end of the document are determined based on the output from the skew sensor 26*a* (a part of the first conveyance sensor 26), and it is determined whether there is a punch hole at the front end of the document based on the output from the punch hole sensor 26*b* (a part of the first conveyance sensor 26).

As a regular document is assumed here, no punch hole is detected at the front end of the document; however, when the skew posture of the document is detected, the sheet feed roller 20 and the separation roller 21 are rotated while the registration roller 22 is stopped so that the skew posture is corrected (see FIG. 5B). The enlarged view of the registration operation illustrated in FIG. 5B illustrates a registration control operation to bend the front end of the document.

After the front end of the document has passed through the second conveyance sensor 27 while the skew posture has been corrected, the operation to read the front surface of the document is performed (see FIGS. 5C and 5D). During the reading operation, the pre-reading roller 23 and the post-reading roller 24 are rotated at the first velocity. The first velocity is a moving velocity suitable for the reading operation of the document reader 11 and corresponding to, for example, the reading resolution set by the external device MC, or the like, or the reading capability of the optical mechanism.

The sheet-discharge reverse rotation roller 25 is rotated in an anticlockwise direction of the drawing surface so that the document is conveyed to the reverse-rotation stop position. Then, the sheet-discharge reverse rotation roller 25 starts to rotate reversely in a clockwise direction of the drawing surface so that the document at the reverse-rotation stop position is conveyed to the left of the drawing surface. During this reverse rotation operation, the initial rear end of the document is positioned at the front end of the reversely moved document.

The document is continuously moved in a reverse direction through the third conveyance sensor 28, and then while the front end (the initial rear end) of the reversely moved document passes through the first conveyance sensor 26, the conveying posture is determined by the skew sensor 26*a*. As described above, the presence of a punch hole is determined by using any one of the determination methods (1) to (3). As a regular document is assumed here, no punch hole is detected on the front end side or the rear end side of the document in any method.

When the skew posture of the reversely moved regular document is detected, the sheet-discharge reverse rotation roller 25 is rotated while the registration roller 22 is stopped so that the skew posture is corrected (see FIG. 5F). The reverse registration operation enlarged view in FIG. 5F illustrates the above-described reverse registration operation.

Subsequently, after the skew posture is corrected and the front end (the initial rear end) of the document passes through the second conveyance sensor 27, the operation is performed to read the back surface of the document (see FIGS. 5G and 5H). During the reading operation, the pre-reading roller 23 and the post-reading roller 24 are rotated at the first velocity to acquire the image on the back surface of the document.

Then, the sheet-discharge reverse rotation roller 25 is rotated in an anticlockwise direction of the drawing surface so that the document is conveyed to the reverse-rotation stop position (see FIG. 5H). Subsequently, the sheet-discharge reverse rotation roller 25 starts to rotate reversely so that the document at the reverse-rotation stop position is conveyed to the left of the drawing surface. In this state, the initial front end of the document is positioned at the front end of the reversely moved document.

Subsequently, the feeding of a second document is started at the same time the discharge of the first document is started (see FIG. 5J). Then, the reading of the second document and the discharge of the first document are completed (see FIG. 5K). Afterward, the same operation as the above-described operation is repeatedly performed.

The conveyance path for a double-sided document, which has printing on both sides, is described above. In the case of a single-sided document, the series of conveyance operations is completed after the operations in FIGS. 5A to 5D.

Next, the conveying velocity of a double-sided document is described. A regular document having no punch hole at the front end nor the rear end of the document is described. As indicated with an arrow in FIGS. 5A to 5K, according to the present embodiment, the document is conveyed at the first velocity, which is a lower velocity, until the document is detected by the first conveyance sensor 26.

A regular document having no punch hole is assumed here. After the skew of the document is determined based on the output from the skew sensor 26*a*, the document is conveyed at the second velocity higher than the first velocity (acceleration control) except when the document is temporarily stopped during the registration control.

Then, after the process is performed to read the front surface of the document at the first velocity, the document is conveyed at the second velocity, which is a higher velocity, until the operation is started to read the back surface of the document (FIGS. 5E and 5F) except when the document is temporarily stopped during the registration control. The operation is performed to read the back surface of the document at the first velocity, and then the first document is conveyed at the second velocity that is controlled by acceleration (FIGS. 51 and 5K). The second document is conveyed at the first velocity in the timings of FIGS. 5J and 5K. As described above, according to the present embodiment, as the acceleration control is performed as much as possible, the series of operations may be completed promptly.

Conveyance Control on Document Having Punch Hole

Various conveyance control methods are described below for the case where a document has a punch hole at least one of the front end and the rear end thereof. First, with reference to FIGS. 6A to 6G, a first conveyance control method 1 is described, in which the registration control is avoided and the acceleration control is relaxed when a punch hole is detected at the front end or the rear end of the document.

First Conveyance Control Method 1 (Operation in Case where Punch Hole is Detected Only at Front End of Document)

FIGS. 6A to 6G illustrate a case where a punch hole is detected only at the front end of the document. The "regular velocity" described in the drawing is the same as the first velocity during image reading. During the acceleration control, the document is conveyed at the second velocity that is higher than the first velocity (the regular velocity). This is also applied to the descriptions in FIGS. 7A to 7D and the subsequent figures.

The description is continuously given based on the assumption of the above. As is the case with FIGS. 5A to 5K, the document is conveyed at the first velocity to the position of the first conveyance sensor 26 (FIG. 6A). Then, in the case of the document, a punch hole at the front end of the document is recognized based on the output of the punch hole sensor 26*b*. The skew of the document may be recognized based on the output of the skew sensor 26*a*.

According to the first conveyance control method 1, when a punch hole at the front end of the document is recognized, the execution of the registration control is avoided, and also the acceleration control is avoided even when the skew of the document is recognized. That is, the first velocity is maintained for the skewed document so that the document is conveyed continuously without being temporarily stopped.

In the case of a regular document having no punch hole, the registration roller 22 is temporarily stopped, and then the regular document is conveyed at the second velocity (FIGS. 5A to 5K). On the other hand, in the case of a document of which a punch hole is detected at the front end thereof, the registration control is avoided, and the document is continuously conveyed at the first velocity, whereby the possibility of damages such as a damage to a hole at the front end of the document or the folding of the front end of the document is greatly reduced. Furthermore, as there is no time for temporarily stopping the registration roller 22, the high-velocity conveyance in this sense may be achieved.

Then, after the operation (FIG. 6B) to read the front surface of the document at the first velocity is finished, the document is conveyed at the second velocity higher than the first velocity until the start of the operation to read the back surface of the document (FIGS. 6C to 6D). This is because the first conveyance control method 1 described here is applied to a document that has a punch hole only at the front end of the document and has no punch hole at the rear end of the document.

Specifically, when the operation to read the front surface of the document is finished (FIG. 6C), the front end of the document having a punch hole has passed through the sheet-discharge reverse rotation roller 25, and therefore no adverse effects occur during the high-velocity conveyance. Furthermore, during the reverse conveyance, the front end of the document having a punch hole is positioned on the document rear end side in the convey direction, and therefore no adverse effects occur during the high-velocity conveyance.

The subsequent operation to read the back surface of the document is performed at the first velocity, which is a lower velocity. After the reading operation, the acceleration control is performed and the document is conveyed at the second velocity until the rear end of the document reaches the reverse-rotation stop position (see FIG. 6E). The operations in FIGS. 6C to 6E described above are the same as the control operation on a regular document.

As illustrated in FIG. 6F, during the third pass for discharging the document, contrary to the case of a regular document, the document is conveyed at the first velocity, which is a lower velocity, until when the front end of the document has passed through the sheet-discharge reverse rotation roller 25. This takes into consideration the fact that a punch hole is present at the front end of the document and prevents damages to the document.

After the front end of the document seems to have passed through the sheet-discharge reverse rotation roller 25, the acceleration control is performed as is the case with a regular document so that the document is conveyed at the second velocity. Therefore, in the case of a document having a hole, the time for the series of operations is not so long, and the high-velocity processing may be achieved.

First Conveyance Control Method 1 (Operation in Case where Punch Hole is Detected at Rear End of the Document)

Next, the case where a punch hole is detected at the rear end of the document is described with reference to FIGS. 7A to 7D. As described above, typically, a punch hole at the rear end is detected based on the output of the punch hole sensor 26*b* during the first passage of the document or is detected based on the image reading operation by the document reader 11.

In this case, depending on whether a punch hole is detected at the front end of the document, the operations in FIGS. 5A and 5B are performed or the operation in FIG. 6A is performed, and then the operation to read the front surface of the document is executed. Then, after the reading operation is finished, the document is conveyed to the reverse-rotation stop position at the second velocity obtained by the acceleration control. At this phase, the central controller 10 determines that there is a punch hole at the rear end of the document.

Therefore, during the subsequent reverse movement, the execution of the registration control is avoided regardless of the output of the punch hole sensor 26*b*, and the acceleration control is avoided so that the conveyance at the first velocity is executed (see FIGS. 7A and 7B). Thus, the possibility of damages such as a damage to a punch hole located at the front end of the document (the initial rear end of the document) during the reverse movement or the folding of the front end of the document (the initial rear end of the document) is greatly reduced.

After the operation to read the back surface of the document conveyed at the first velocity is completed, the document is conveyed to the reverse-rotation stop position at the second velocity obtained by the acceleration (FIG. 7C). As the front end of the document having undergone the reading operation has already passed through the sheet-discharge reverse rotation roller 25, no adverse effects occur during the high-velocity conveyance. The subsequent sheet discharge operation is also performed at the second velocity (FIG. 7D). Thus, the document having a hole do not get damaged, and the speed of the series of operations is increased.

Second Conveyance Control Method 2

Although the first conveyance control method 1, in which the registration control is avoided and the acceleration control is relaxed, is described above, there is no particular limitations on this method. For example, it is possible to use the method in which the registration operation is performed while the acceleration control is relaxed.

FIGS. 8A and 8B illustrates a second conveyance control method 2 and illustrates the case where a punch hole is detected at the front end of a document. According to this conveyance control method, when a punch hole and the skew posture are detected from the document that has reached the position of the first conveyance sensor 26 at the first velocity, the registration control operation is performed. The stopped registration roller 22 is then rotated at the first velocity, which is a low velocity, to convey the document. Thus, the tilt posture of the document may be corrected. Further, as the document is then conveyed slowly, damages to the document having a hole may be suppressed.

FIGS. 9A and 9B also illustrates the second conveyance control method 2 and illustrates the case where a punch hole is detected at the rear end of the document. In this case, when a punch hole is detected at the rear end of the document and the reversely moved document has the skew posture at the position of the first conveyance sensor 26, the registration control operation is performed, and the stopped registration roller 22 is then rotated at the first velocity, which is a low velocity, to convey the document.

Only the relevant part of the second conveyance control method 2 has been described above, the conveyance operations at other times may be performed as appropriate. Preferably, the same acceleration control as that in the case of the first conveyance control method 1 is performed.

Third Conveyance Control Method 3

FIGS. 10A to 10C illustrates a third conveyance control method 3 in which the registration control operation is performed at a safe velocity lower than the first velocity when a punch hole is detected at the front end of the document. According to the third conveyance control method 3, when a punch hole is detected and a skew posture is detected, the registration control operation is performed, and the stopped registration roller 22 is then rotated at a safe velocity lower than the first velocity to convey the document. The safe velocity is, for example, approximately ⅔ of the first velocity. When the first velocity is 300 mm/s, the safe velocity is 200 mm/s.

Then, before the front surface of the document is read, the conveying velocity is reset to the first velocity, and a transition is made to the image reading process. As described above, according to the third conveyance control method 3, the document is conveyed more slowly after the skew posture thereof has been corrected; thus, it is possible to effectively suppress damages to a document having a hole.

FIGS. 11A to 11C illustrates an operation according to the third conveyance control method 3 when a punch hole is detected at the rear end of the document. In this case, when the reversely moved document has a skew posture at the position of the first conveyance sensor 26, the registration control operation is executed, and the stopped registration roller 22 is then rotated at the above-described safe velocity to convey the document.

In this case, the document is conveyed more slowly after the skew posture thereof has been corrected; thus, it is possible to effectively suppress damages to a document having a hole. Then, before the back surface of the document is read, the conveying velocity is reset to the first velocity, and a transition is made to the image reading process.

The first conveyance control method 1 to the third conveyance control method 3 have been described above. The summary of the characteristic parts is as follows.

First, in the case of the application of the first conveyance control method 1, as illustrated in FIGS. 6B and 6F, when a hole is detected at the front end of a single-sided or double-sided document, the registration control and the acceleration control are avoided so that the document is conveyed at the regular velocity (the first characteristic configuration). Furthermore, as illustrated in FIG. 7B, when a hole is detected at the rear end of a double-sided document, the registration control and the acceleration control are avoided so that the document is conveyed at the regular velocity (the second characteristic configuration). In either case, the document having a hole is smoothly passed at the first velocity (the regular velocity) without being pushed against the registration roller 22, whereby it is possible to effectively reduce the possibility of damages such as a damage to a hole at the front end or the rear end of the document.

As illustrated in FIG. 6E and FIG. 7D, even when a punch hole is detected at the front end or the rear end of the document, the acceleration control and the registration control are performed unless the punch hole is located at the front end side in the conveying direction (the third characteristic configuration), whereby it is possible to improve the processing speed, and the posture of a skewed document may be corrected.

In the case of the application of the first conveyance control method 1, as illustrated in FIGS. 6C and 6G, and FIG. 7C, even when a hole is detected at the front end side of the document, the acceleration control is performed after the front end of the document has passed through all the rollers (a fourth characteristic configuration), whereby it is possible to improve the processing speed without causing any damages to the document.

In the case of the application of the second conveyance control method 2, as illustrated in FIG. 8B and FIG. 9B, when a hole is detected on the document front end side in the convey direction, the registration control is performed and the document is then passed through the registration roller 22 slowly (a fifth characteristic configuration), whereby it is possible to reduce damages to the document while a skew is corrected.

In the case of the application of the third conveyance control method 3, as illustrated in FIG. 10B and FIG. 11B, when a hole is detected on the document front end side in the convey direction, the registration control is performed and the document is passed through the registration roller 22 more slowly (a sixth characteristic configuration), whereby it is possible to ensure that damages to the document are further reduced while a skew is corrected.

Although the description is given above based on the assumption that a document having a hole is automatically detected, there is no particular limitation. As the user knows precisely about, for example, the type of document, i.e., a document having a hole, the position of a hole of the document, or the strength of the document, the state of the document may be determined in accordance with the user's instruction on the state of the document (a seventh characteristic configuration).

Figure 12:
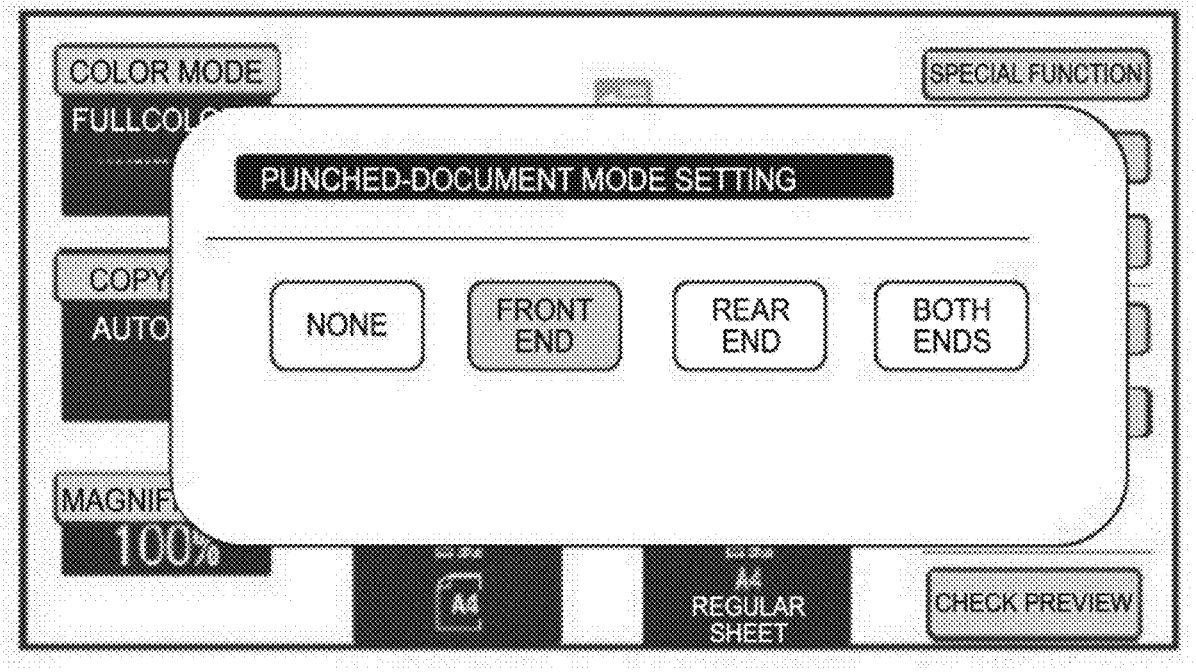
FIG. 12 is a diagram illustrating a case where a user setting is received for a punch hole.

FIG. 12 is a diagram illustrating an embodiment including the seventh characteristic configuration. FIG. 12 illustrates a display screen that prompts the user to specify the presence or absence of an open hole and the position of the open hole. Typically, a touch panel display screen is used. In the case of the application of this method, there is no need to execute a detection process for a punch hole, or the like, during the document conveyance, and each of the above-described controls may be executed more reliably.

DESCRIPTION OF REFERENCE NUMERALS

SC Scanner apparatus (sheet conveyance apparatus)
11 Document reader (image processor)
18 Document feeder (sheet conveyer)
SNS Detection sensor (opening detector)
22 Registration roller (registration device)
PA Document (sheet)

What is claimed is:

1. A sheet conveyance apparatus comprising:

a sheet conveyer that conveys a sheet from a start position to an end position;

an opening detector that detects an open hole of a sheet being conveyed on the sheet conveyer;

a registration device that temporarily stops the sheet being conveyed on the sheet conveyer at a predetermined timing and corrects a tilt posture of the sheet;

an image processor that acquires image information from the sheet being conveyed on the sheet conveyer or forms an image on the sheet being conveyed on the sheet conveyer; and a controller electrically coupled to the sheet conveyer, the opening detector, the registration device, and the image processor, wherein the controller conveys the sheet at a predetermined regular velocity at a timing when the image processor acquires image information from the sheet being conveyed on the sheet conveyer or forms an image on the sheet being conveyed on the sheet conveyer, and the controller avoids an operation of the registration device and keeps a present velocity to convey the sheet on the sheet conveyer without temporarily stopping the sheet having the tilt posture at the registration device when, based on a detection result of the opening detector, the open hole is detected by the opening detector at a front end of the sheet at the start position.

2. A sheet conveyance apparatus comprising:

a sheet conveyer that conveys a sheet from a start position to an end position;

an opening detector that detects an open hole of a sheet being conveyed on the sheet conveyer;

a registration device that temporarily stops the sheet being conveyed on the sheet conveyer at a predetermined timing and corrects a tilt posture of the sheet;

an image processor that acquires image information from the sheet being conveyed on the sheet conveyer or forms an image on the sheet being conveyed on the sheet conveyer; and a controller electrically coupled to the sheet conveyer, the opening detector, the registration device, and the image processor, wherein the controller conveys the sheet at a predetermined regular velocity at a timing when the image processor acquires image information from the sheet being conveyed on the sheet conveyer or forms an image on the sheet being conveyed on the sheet conveyer, and the controller avoids an operation of the registration device and keeps a present velocity to convey the sheet on the sheet conveyer without temporarily stopping the sheet having the tilt posture at the registration device when, based on a detection result of the opening detector, the open hole is detected by the opening detector at a rear end of the sheet at the start position.

* * * * *